United States Patent [19]

Barth

[11] 4,326,352

[45] Apr. 27, 1982

[54] SIGN POST

[75] Inventor: Duane D. Barth, Burnsville, Minn.

[73] Assignee: Heritage Products Intl., Inc., Burnsville, Minn.

[21] Appl. No.: 100,890

[22] Filed: Dec. 6, 1979

[51] Int. Cl.[3] ..... G09F 15/00; F16M 13/00

[52] U.S. Cl. ..... 40/607; 248/156; 248/545

[58] Field of Search ..... 40/617, 607, 610, 606, 40/611, 612, 613, 616; 248/156, 407, 159, 545

[56] References Cited

U.S. PATENT DOCUMENTS

| | | | |
|---|---|---|---|
| 1,744,321 | 1/1930 | Markman | 40/617 X |
| 1,857,314 | 5/1932 | Markman | 40/617 X |
| 2,072,573 | 3/1937 | Vigliotti | 40/607 X |
| 2,559,302 | 7/1951 | Louft | 248/156 X |
| 2,584,713 | 2/1952 | Kanaval | 40/617 X |
| 2,738,941 | 3/1956 | Laurich et al. | 248/156 X |
| 3,143,817 | 8/1964 | Paulson | 40/606 |
| 3,218,746 | 11/1965 | Hawkins, Jr. | 40/607 |
| 3,519,234 | 7/1970 | Matson | 248/156 |
| 3,606,222 | 9/1971 | Howard | 248/156 X |
| 3,935,655 | 2/1976 | Fritzinger | 40/607 |
| 4,065,085 | 12/1977 | Gellatly | 248/156 X |
| 4,249,715 | 2/1981 | Barth | 40/607 X |

OTHER PUBLICATIONS

ERA ® Yard Sign Panel-Order Form Publication.
Specification for Century 21 Hanging Yard Sign-Post and Cross Arm-Publication.

*Primary Examiner*—Robert Peshock
*Assistant Examiner*—Michael J. Foycik
*Attorney, Agent, or Firm*—Merchant, Gould, Smith, Edell, Welter & Schmidt

[57] ABSTRACT

A sign post has a hollow post with a cross arm assembly inserted into the upper end of a post and a stake inserted into the lower end. Hooks and a slotted member are attached to the horizontal tube of the cross arm assembly. A first sign may be hung from the hooks while a second sign may be inserted into the slotted member. Stake includes expander elements for snugly fitting within post and a plate for preventing the sign post from turning in the wind.

18 Claims, 12 Drawing Figures

34'
26'
46'
40'
32'
24'
20'
22'
58'
28'
66
42'
50'
54'
68
38'
62
64
12
11

SIGN POST

FIELD OF THE INVENTION

This invention relates to a sign post and, more particularly, to a hollow post with a hollow, lateral cross arm from which a sign can be fastened, the assembly being attached to a stake which is easily insertable into the ground.

BACKGROUND OF THE INVENTION

Posts have been used, of course, with signs for many years. The idea of extending a lateral cross arm from the top of a post and hanging a sign from the cross arm was probably conceived more recently. However, sign posts which hold signs from a lateral cross arm have been known in the prior art.

In the field of real estate, sign posts with lateral cross arms for holding signs became common in the 1970's. One such sign post used 4"×4" redwood lumber for both the vertical member and the horizontal cross member. A notch the width of the lumber was milled halfway into each piece so that when bolted together the two pieces were in the same plane. The two pieces were transported as a single assembly in an automobile. At the installation site, the vertical member was placed in a pre-drilled over-sized hole with loose dirt tamped around it. A real estate "For Sale" sign was then hung from screw eyes screwed into the laterally extending cross member.

The problem with the redwood sign post is that it was heavy and difficult to implant in the ground. Often, there were difficulties in drilling the installation hole, especially in winter. Not only was this a difficult chore, but removal of the sign post was also difficult when the ground was frozen. Furthermore, in wet weather, the sign post was top-heavy and tended to tip over as a result of the loosely tamped soil around the base of the vertical member.

SUMMARY OF THE INVENTION

The present invention is comprised of a post with a cross member attached to the upper portion of the post and a stake for insertion into the ground attached to the lower hollow portion of the post.

In a preferred embodiment, the cross member is comprised of three easily extruded pieces attached to one another. All cross member pieces, as well as the post, are hollow. To make the cross member, a vertical guide member is inserted through a hole in a horizontal support member and fastened to that member. The vertical guide member is sufficiently long to extend both above and below the horizontal support member. A cap member fits about the upper portion of the vertical guide member. Additionally, a slotted member is attached to the top of the horizontal support member with threaded hooks inserted through holes from the bottom side of the horizontal support member. This allows one sign to be hung from the hooks below the horizontal support member and another sign to be inserted into the slot of the slotted member above the horizontal support member.

The stake component has smaller cross-sectional dimensions than the post. It has metal expander elements attached in a spaced apart relationship on its upper portion. The outer contour of the expander elements allow the post to slide snugly over the stake and expander elements.

In use, the stake is relatively easily hammered into the ground. The post is placed over the expander elements of the stake, and the cross member assembly is inserted into the upper end of the post.

It is particularly advantageous that the disclosed sign post can be inserted into packed or frozen ground without having to drill a hole in the ground. On the other hand, when ground is very soft or moist, the sign post, because of its light-weight, hollow design, is not nearly as likely to tip over as commonly used wooden posts with lateral cross arms. Additionally, when the sign post is given a square contour it is prevented by square expander elements on the upper portion and a plate on the lower portion of the stake from rotating in the wind. Vandalistic stealing of the sign post is discouraged by fastening the sign post to the stake.

The invention is particularly useful in the field of real estate. A "For Sale" sign can be hung below the laterally extending horizontal member and, subsequently, a "Sold" sign can be inserted above the horizontal support member in the attached slotted member. However, it is to be understood that the invention is useable in other areas also. For example, a mailbox or a flower plant could easily be attached at the outer end of the horizontal member of the sign post. Consequently, discussion of the invention as it relates to real estate is intended to be exemplary only and certainly does not limit the scope of the invention to that application.

For a better understanding of the invention, its advantages, and objects attained by its use, reference should be had to the drawings which form a further part hereof, and to the accompanying descriptive matter in which there are illustrated and described preferred and other embodiments of the invention.

DESCRIPTION OF THE PREFERRED EMBODIMENTS

Figures 1, 2, 3, 4, 5, 6, 7:
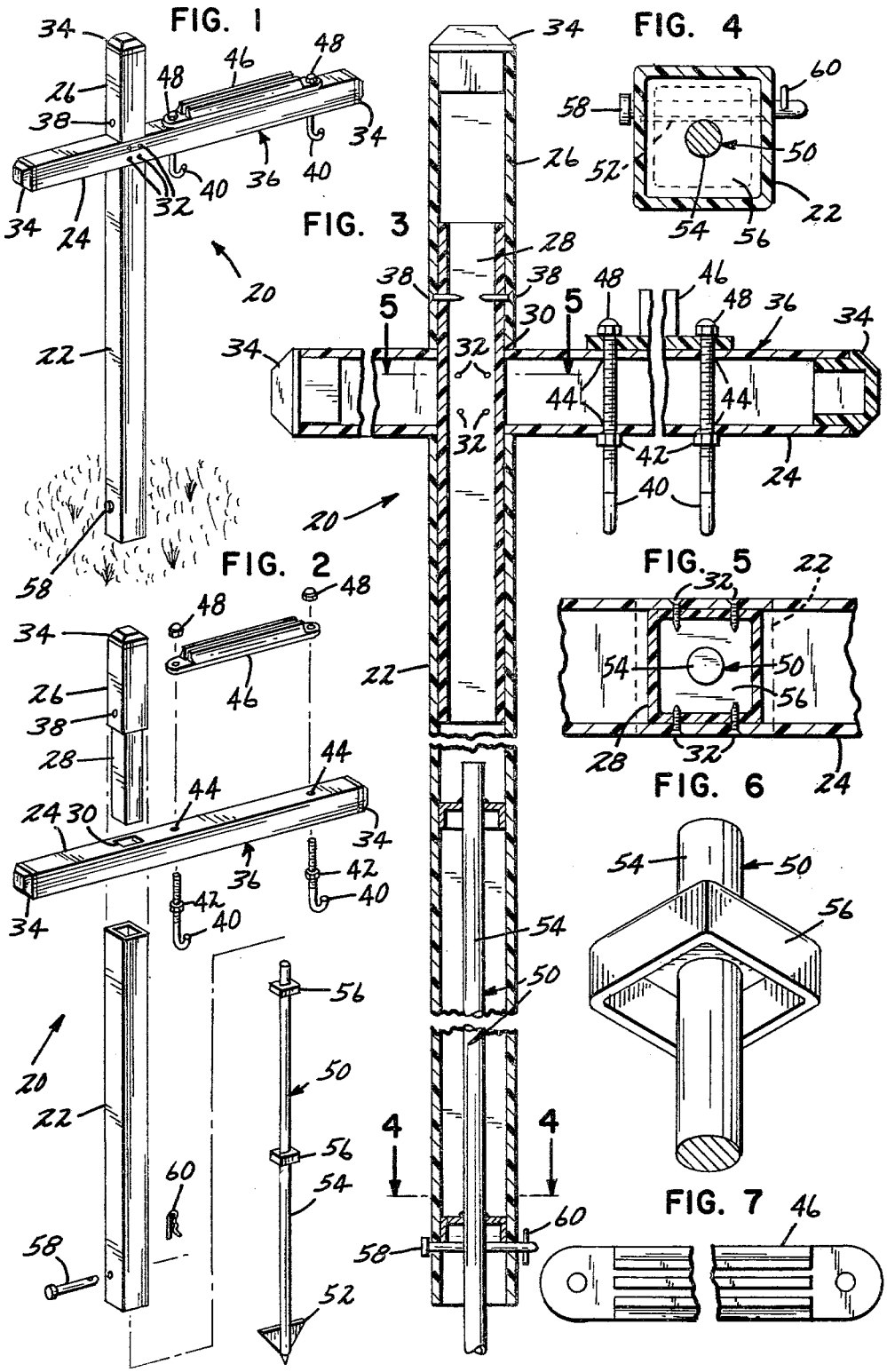
FIG. 1 is a perspective view of the invention as installed.
FIG. 2 is an exploded, perspective view of the invention.
FIG. 3 is a front, cross-sectional view of the invention.
FIG. 4 is a top view of an expander element, taken along line 4—4 of FIG. 3.
FIG. 5 is a cross-sectional view of a vertical guide member at the point of attachment to a horizontal support member, taken along line 5—5 of FIG. 3.
FIG. 6 is a perspective view of a stake and an attached expander element.
FIG. 7 is a top view of a slotted member.

Referring now to the drawings wherein like reference numerals designate identical or corresponding parts throughout the several views, and more particularly to FIG. 1, the present invention, a support structure and more particularly a sign post, is designated generally as 20. The component parts of sign post 20 are more explicitly shown in FIG. 2.

Post 22 is the vertical base member for sign post 20. Horizontal member 24 rests on post 22 and is the support member for signs. Cap member 26 rests on top of horizontal member 24 and appears to be an extension of post 22. Post 22 and horizontal member 24 are approximately the same length, a length approximately equivalent to the shoulder height of an average-sized adult. Such length easily allows a person to hang or remove signs from sign post 20 when horizontal member 24 rests on top of vertically standing post 22. Horizontal member 24 contacts post 22 a substantial distance from the middle of horizontal member 24. Thus, a longer section of horizontal member 24 extends on one side of post 22 and a shorter section extends on the other side. Cap member 26 is approximately equal in length to the shorter section of horizontal member 24.

In the preferred embodiment, post 22, horizontal member 24 and cap member 26 all have the same square tube, cross-sectional shape as shown in FIG. 4 for post 22. Tube wall thickness provides structural strength, and, using a high-impact ABS material, a one-eighth inch wall thickness has been found to be adequate.

Post 22, horizontal member 24 and cap member 26 are all held by vertical guide member 28, a squarely contoured tube having a hollow interior in the preferred embodiment. The outer contour of vertical guide member 28 is slightly smaller than the inner square contour of post 22 and cap member 26. Vertical guide member 28 is sufficiently long so that when it is inserted transversely through an appropriately sized hole 30 in horizontal member 24, it extends a few inches above horizontal tube 24 and a few inches below. Screws 32 securely attach vertical guide member 28 to horizontal member 24 (see FIG. 5). It is to be understood, of course, that although a particular fastening means is indicated for attaching certain components together, other fastening means may be used for equivalent results.

It should also be understood that the construction could be reversed, with the hole 30 located in the vertical post and the guide member extending horizontally, without departing from the invention.

End inserts 34 are placed in both ends of horizontal member 24 and in the top end of cap member 26. In the preferred embodiment the end inserts 34 have one end portion of square outer contour sufficiently small to snugly slide into the indicated mating components. The outer wall of the other end portion of end inserts 34 is also square, but it is larger so as to mate with the outer contour of horizontal member 24 and cap member 26. The exposed end of end inserts 34 is decoratively shaped. End inserts 34 are attached with glue.

The cross member assembly 36 is completed by adding sign holding elements to the horizontal member 24 and by attaching cap member 26 to vertical guide member 28 with screws 38 (see FIG. 3). Metal hooks 40 are used to hang signs from horizontal member 24. The straight end of a hook 40 is threaded. A nut 42 is turned down to about the midpoint of hook 40. The threaded ends of hooks 40 are inserted through holes 44 in horizontal support member 24. Holes 44 are spaced apart and located on the longer segment of horizontal member 24 which extends away from post 22. Slotted member 46 is placed on the upper side of horizontal member 24 so that holes at its ends fit over the threaded ends of hooks 40. Cap nuts 48 are turned onto the threaded end of hooks 40 to lock hooks 40 and slotted member 46 onto horizontal tube 24. Slotted member 46 holds a sign above horizontal member 24.

Referring to FIG. 7, slotted member 46 is generally rectangular in shape, having rounded ends and holes at either end for insertion of hooks 40. The segment between the holes is thicker than the end segments where the holes are located and is decoratively shaped to include a slot running longitudinally down the middle. The width of slotted member 46 is equal to or less than the width of one side of horizontal member 24.

Sign post 20 includes a stake 50 having a substantially smaller cross-sectional dimension than post 22 and shaped for easy insertion into the ground. In the preferred embodiment, stake 50 includes a triangular plate 52 attached to the lower end of a rod 54 to prevent rotation of the stake 50. Rod 54 is pointed at its lower end, with the apex of triangular plate 52 downward. Two expanders 56 are spaced apart and attached to the upper portion of rod 54. Referring to FIG. 6, expander 56 is comprised of a plate having a hole at its center so that rod 54 may be inserted through the hole and welded to the plate. Flanges extend downwardly from all four edges of the plate so that the outer contour of the expander 56 is slightly smaller than the inner contour of post 22.

Pin 58 is inserted through a hole near the lower end of post 22 so that the pin, when in place, is below lower expander 56 when post 22 has been placed about stake 50. Pin 58 passes to one side of rod 54 and is held in place with clip 60 (see FIG. 4). Pin 58 as secured by clip 60 prevents vandals from easily removing post 22 from stake 50.

Figures 8, 9, 10, 11, 12:
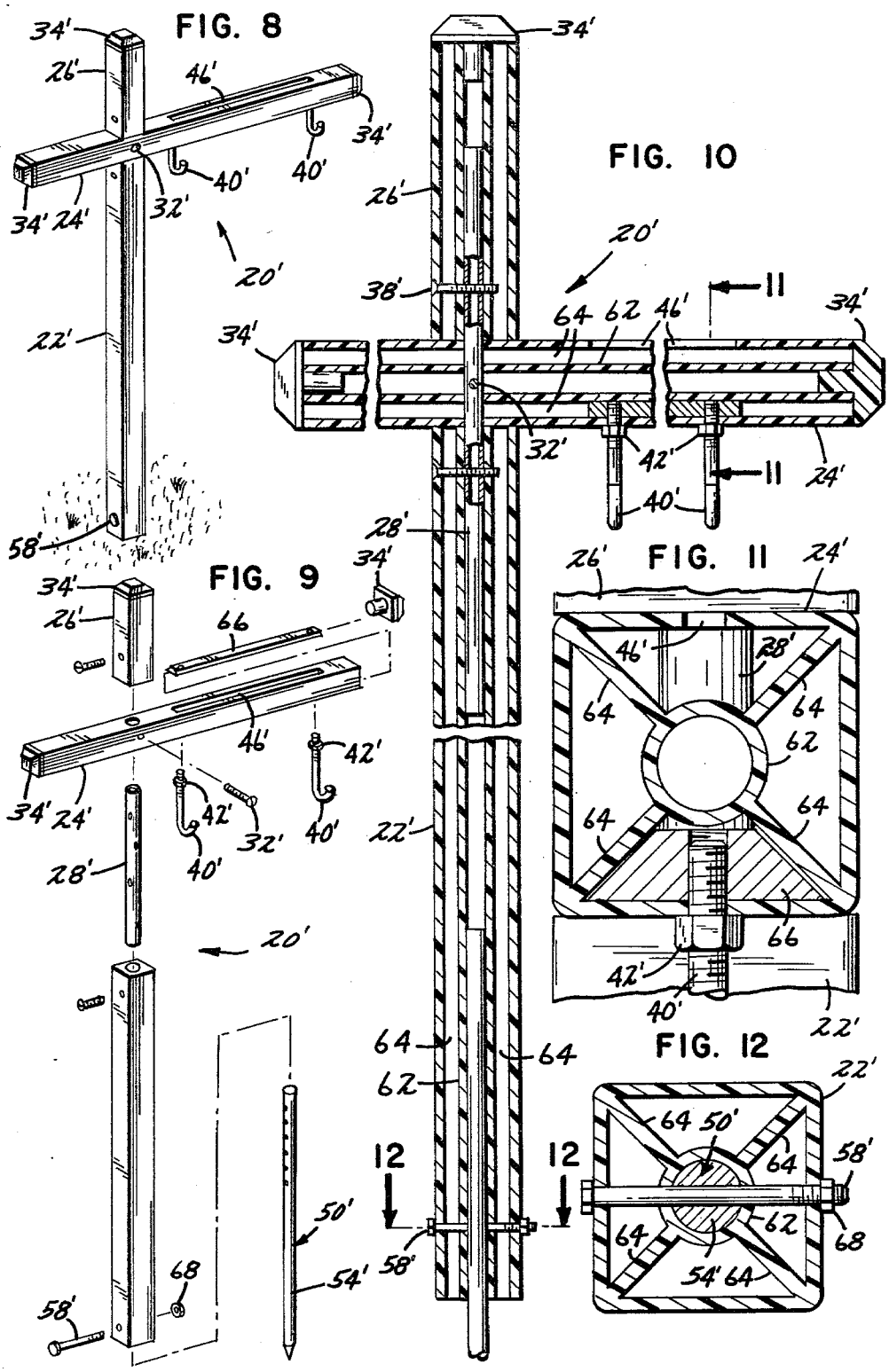
FIG. 8 is a perspective view of an installed alternate embodiment of the invention.
FIG. 9 is an exploded, perspective view of the alternate embodiment of the invention.
FIG. 10 is a front, cross-sectional view of the alternate embodiment of the invention.
FIG. 11 is a cross-sectional view of the horizontal support member at the location of a sign hook, taken along line 11—11 of FIG. 10.
FIG. 12 is a cross-sectional view of the vertical base member at the point where the vertical base member is attached to the stake, taken along line 12—12 of FIG. 10.

An alternate embodiment of the invention is shown generally as sign post 20′ in FIG. 8. The components of sign post 20′ are shown more particularly in FIG. 9. Post 22′, horizontal member 24′ and cap member 26′ have similar lengths, similar relative orientations with respect to each other, and similar square outer contours (although a round or other outer contour may also be appropriate) relative to the corresponding components in the preferred embodiment, but the internal structure is different. Taking horizontal member 24′ as shown in FIGS. 10 and 11 as an example, the internal structure is comprised of a tube 62 centered in horizontal member 24′ with plates 64 extending radially from tube 62 to the corners of the square horizontal member 24′ and attached at both tubes 62 and horizontal member 24′. The internal structure extends from one end of horizontal member 24′ to its other end.

Vertical guide member 28′ is cylindrical and has a slightly smaller outer diameter than the inner diameter of structural tube 62. Vertical guide member 28′ is sufficiently long so that when it is inserted transversely through an appropriately sized hole in horizontal member 24′, it extends a few inches above horizontal member 24′ and a few inches below. Screw 32′ securely attaches vertical guide member 28′ to horizontal member 24′.

End inserts 34' are placed in both ends of horizontal member 24' and in the top end of cap member 26'. The end inserts 34' are decoratively shaped at one end with a square outer wall which mates with the outer contour of horizontal member 24' and cap member 26'. The other end portion is a small cylinder of diameter which allows it to snugly slide into tube 62 of the indicated mating components. Each end insert 34' is attached with glue.

Before installing the end insert 34' at the end of the longer segment of horizontal member 24', nut 66 must be inserted and hooks 40' screwed into place. Nut 66 has a trapezoidal cross-sectional shape with a sufficiently small outer contour to fit within the space defined by tube 62, the lower two plates 64, and the inside bottom wall of horizontal member 24'. Nut 66 has threaded holes at its ends in order to accept the threaded portion of hooks 40'. Nut 66 is sufficiently long to allow hooks 40' to be installed in a convenient, spaced-apart relationship. Hooks 40' are metal and are formed in the shape of a semi-circular hook at their bottom portion and are threaded along the top upper portion. Nut 42' is turned down approximately an inch on the threaded portion of hooks 40'. Hooks 40' are inserted through holes in the bottom side of horizontal tube 24' and secured by nut 66.

With the attachment of vertical guide member 28' to horizontal member 24', the cross member assembly is completed with the installation of hooks 40', end inserts 34' and the installation of cap member 26'. Cap member 26' is simply slid onto vertical guide member 28' and fastened with screw 38'.

Sign post 20' includes a stake 50' which is comprised of a rod 54'. Rod 54' is straight from top to bottom, but it could just as well be a spiral along its lower portion so it could be screwed into the ground. Rod 54' is pointed at its lower end for easy insertion into the ground, and at its upper end it has several holes spaced apart along a longitudinal line. With stake 50' anchored in the ground, post 22' is placed over the upper portion of stake 50'. Bolt 58' passes through a hole in post 22' and through one of the holes in the upper portion of rod 54' and is securely attached with nut 68. The invention may be practiced as well using equivalent attaching mechanisms at the upper end of stake 50', for example, the upper portion of rod 54' may be flat and be bolted to the outside of post 22' or there may be a metal box welded to the top of a rod such that the box fits about post 22' and attaches to it.

In operation, sign post 20 is transported from one location to another in a broken-down configuration consisting of the cross member assembly 36, post 22 and stake assembly 50. On location, stake 50 is pounded with a hammer or other device into the ground. It is inserted to the point where the lower expander 56 is a few inches above the surface of the ground. Post 22 is then placed over the top of stake 50 so that the inner contour of the post aligns and slides over expanders 56. Pin 58 is inserted through the holes in post 22 and locked in place with clip 60. Cross member 36 is then oriented to allow vertical guide member 28 to slip into the upper hollow portion of post 22. In this state of assembly, a first sign can be hung from hooks 40, and a second sign can be inserted into the slotted member 46. Sign post 20 is easily disassembled by reversing the above-described assembly procedure. Alternate embodiment sign post 20' is assembled and disassembled correspondingly. Note that slotted member 46 is replaced with a slot 46' in horizontal member 24' in embodiment 20'.

The lightweight tubular design of sign post 20 compared to a design using solid wood members results in a lesser susceptibility to tipping when stake 50 of sign post 20 is resting in soft or wet ground. Furthermore, when the tubes used in sign post 20 are square as in the preferred embodiment, the square outer shape of guide member 28 interacting with the square inner contour of base member 22 prevents rotation by the wind or vandals of horizontal member 24 and cap member 26 relative to base member 22. In like manner, the square shape of expanders 56 prevents rotation of base member 22 relative to stake 50. The flat plate 52 when it is at least partially inserted into the ground prevents stake 50 from rotating relative to the ground. Thus, the various elements of sign post 20 cooperate to keep an installed sign post in its originally installed orientation.

Numerous characteristics and advantages of the invention have been set forth in the foregoing descrpition, together with details of the structure and function of the invention. The disclosure, however, is illustrative only, and it is therefore to be understood that changes may be made in detail, especially in matters of shape, size, and arrangement, within the principle of the invention, to the full extent extended by the general meaning of the terms in which the appended claims are expressed.

What is claimed is:

1. A sign post for holding a sign above the surface of the ground comprising:

an elongated stake having a small cross-sectional dimension for easy insertion into the ground;

a post having a substantially larger cross-sectional dimension than said stake;

means for removably attaching said post to said stake, said attaching means holding said post in a vertically-disposed orientation when said stake is inserted into the ground;

a support member;

a guide member having an upper portion extending above said support member and a lower portion extending below said support member; and a cap member fitted about the upper portion of said guide member;

said guide member for holding said post, said support member and said cap member together.

2. A sign post in accordance with claim 1 further comprising means for attaching a sign to said support member.

3. A sign post in accordance with claims 1 wherein said support member and said cap member are an integral first piece and said post and said guide member are an integral second piece.

4. A sign post in accordance with claim 3 wherein said first and second pieces upon being fitted together have substantially identical outer cross-sectional dimensions, said first and second pieces being substantially hollow, whereby the lighter weight of said hollow pieces relative to a solid piece allows said sign post to be relatively lighter and less susceptible to tipping when anchored in soft or wet ground.

5. A support structure comprising:

an elongated stake having a small cross-sectional dimension for easy insertion into the ground, said stake having an upper portion and a lower portion;

a post with an upper portion and a lower portion and having a substantially larger cross-sectional dimension than said stake, said post being removably attached to said stake at its lower portion in a linear relationship therewith such that said post is held in a generally vertical orientation when said stake is generally vertically inserted into the ground;

a support member, said support member and said post having substantially the same outer cross-sectional dimensions thereby providing a consistent outer appearance for said structure;

one of said support member and post having a transversely oriented opening therein; and means passing through said opening for attaching said support member to said post to hold said support member generally horizontally disposed from the upper portion of said generally vertically disposed post.

6. A support structure in accordance with claim 5 wherein said post is at least partially hollow, said opening is in said support member, and said attachment means includes a guide member extending from the hollow portion within said post through the opening in said support member to a cap member which fits about said guide member.

7. A support structure in accordance with claim 6 further comprising means for attaching a sign to said support member.

8. A support structure in accordance with claim 6 wherein said post, said support member, and said cap member are substantially square tubes having the same cross-sectional dimensions.

9. A support structure in accordance with claim 6 wherein said post, said support member, and said cap member have the same structure running the length of each, the structure being that of a substantially square tube having four internal corners with a plate member extending from each corner to an axially-aligned, circular tube.

10. A sign post for holding a sign above the surface of the ground, comprising:

a support member having a transversely oriented opening near a first end of said support member;

a guide member inserted perpendicularly through the opening in said support member and fastened to said support member leaving portions of said guide member extending both above and below said support member;

a cap member having a lower edge, said cap member fitted about the upper portion of said guide member and fastened, said cap member at its lower edge contacting said support member;

a base member having an upper end and at a lower end, said base member fitted about the lower portion of said guide member so said base member at its upper end contacts said support member; and an elongated stake having a lower portion for easy insertion into the ground and an upper portion enveloped by the lower hollow portion of said base member;

said support member, said cap member and said base member being tubular with outer cross-sectional dimensions substantially the same;

whereby the lighter weight of the tubular members relative to a solid member results in said sign post being relatively lighter and less susceptible to tipping when said stake is anchored in soft or wet ground.

11. A sign post in accordance with claim 10 wherein the internal contour of said base member is substantially square, wherein said guide member has a square outer contour substantially similar in shape but smaller in size than the internal counter of said base member, wherein an expander pad is fixedly attached to the upper portion of said stake, said expander pad having a square outer contour substantially similar in shape but smaller in size than the internal contour of said base member, and wherein a flat plate is attached to the lower portion of said stake, whereby the square shape of said guide member prevents rotation of said support member and said cap tube relative to said base member, the square shape of said expander pad prevents rotation of said base tube relative to said stake and the flat plate when at least partially inserted into the ground prevents rotation of said stake relative to the ground.

12. A sign post in accordance with claim 11 further comprising a means for anchoring said post to said stake to prevent vandals from taking said post without extracting said stake from the ground with said post attached to said stake.

13. A sign post for holding a sign above the surface of the ground, comprising:

a support tube having a transversely oriented opening near a first end of said tube;

a guide tube inserted perpendicularly through the opening in said support tube and fastened to said support tube leaving portions of said guide tube extending both above and below said support tube;

a cap tube having a lower edge and fitted about the upper portion of said guide tube and fastened, said cap tube at its lower edge contacting said support tube;

a base tube having an upper edge and having a substantially square internal contour, said base tube fitting about the lower portion of said guide tube so said base tube at its upper edge contacts said support tube; and a stake having a first end for insertion into the ground and an expander pad fixedly attached to a second end of said stake opposite the first end, said expander pad having an outer contour substantially similar in shape but smaller in size than the internal contour of said base tube, the second end of said stake including said expander pad extending into said base tube holding said base tube in a vertical orientation when said stake is inserted into the ground.

14. A sign post in accordance with claim 13 wherein the external contour of said horizontal support tube, said cap tube and said vertical base tube is identical and substantially square.

15. A sign post in accordance with claim 13 wherein the internal cross-sectional contour of said base tube is substantially square, wherein said guide tube has a square outer contour substantially similar in shape but smaller in size than the internal contour of said base tube, and wherein a flat plate is attached near the first end of said stake whereby the square shape of said guide tube prevents rotation of said support tube and said cap tube relative to said base tube, the square shape of said expander pad prevents rotation of said base tube relative to said stake and the flat plate when at least partially inserted into the ground prevents rotation of said stake relative to the ground.

16. A sign post in accordance with claim 15 further comprising hook means, attached to the lower side of said horizontal support tube, for holding a sign.

17. A sign post in accordance with claim 16 further comprising a slotted member, attached to the upper side of said horizontal support tube, for holding a sign.

18. A sign post in accordance with claim 13 further comprising a means for anchoring said post to said stake to prevent vandals from taking said post without extracting said stake from the ground with said post attached to said stake.

* * * * *